United States Patent [19]

Gerding et al.

[11] 3,952,928

[45] Apr. 27, 1976

[54] MULTI-CHAMBERED TUNDISH TO INDUCE DAMPENED FLOW

[75] Inventors: Charles Christian Gerding, Pittsburgh; Louis John Todora, Aliquippa, both of Pa.

[73] Assignee: Jones & Laughlin Steel Corporation, Pittsburgh, Pa.

[22] Filed: May 31, 1975

[21] Appl. No.: 579,523

Related U.S. Application Data

[62] Division of Ser. No. 470,510, May 16, 1974, Pat. No. 3,907,163, which is a division of Ser. No. 324,700, Jan. 18, 1973, Pat. No. 3,831,659.

[52] U.S. Cl. ..... 222/564; 164/133; 164/281

[51] Int. Cl.[2] ..... B22D 37/00

[58] Field of Search ..... 266/34 R, 34 V; 164/82, 164/133, 134, 281; 222/1, 547, 564

[56] References Cited

UNITED STATES PATENTS

| | | | |
|---|---|---|---|
| 2,804,665 | 9/1957 | Harter et al. | 164/134 X |
| 3,052,936 | 9/1962 | Hamilton | 164/82 X |
| 3,525,510 | 8/1970 | Richardson | 266/34 |

*Primary Examiner*—Stanley H. Tollberg
*Assistant Examiner*—David A. Scherbel
*Attorney, Agent, or Firm*—G. K. White; T. A. Zalenski

[57] ABSTRACT

Liquid materials are dispensed at a low velocity through the use of a multi-chambered tundish which induces a dampening effect upon the flow of the liquid material which passes through the tundish. The tundish is well suited as a liquid metal source in continuous strip casting methods.

4 Claims, 6 Drawing Figures

FIG. 1
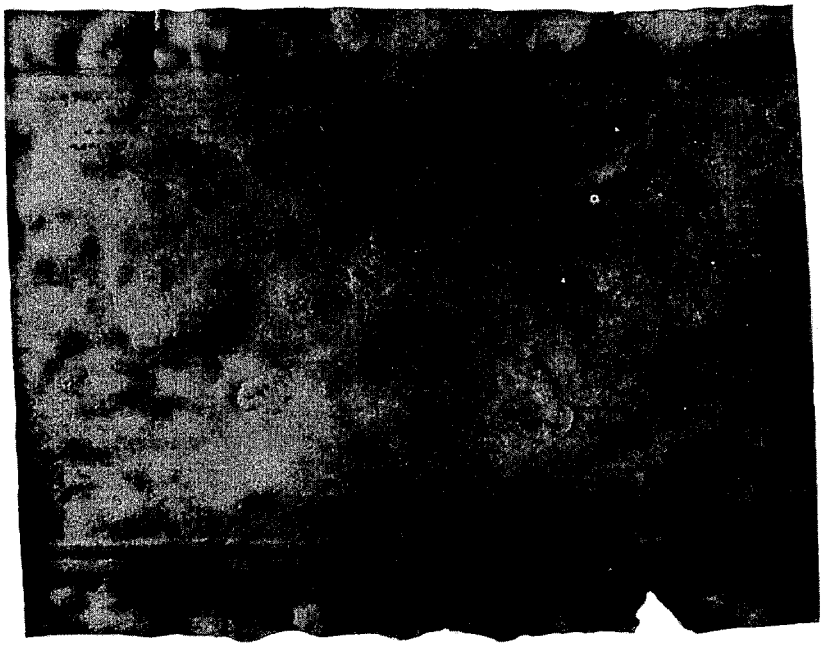
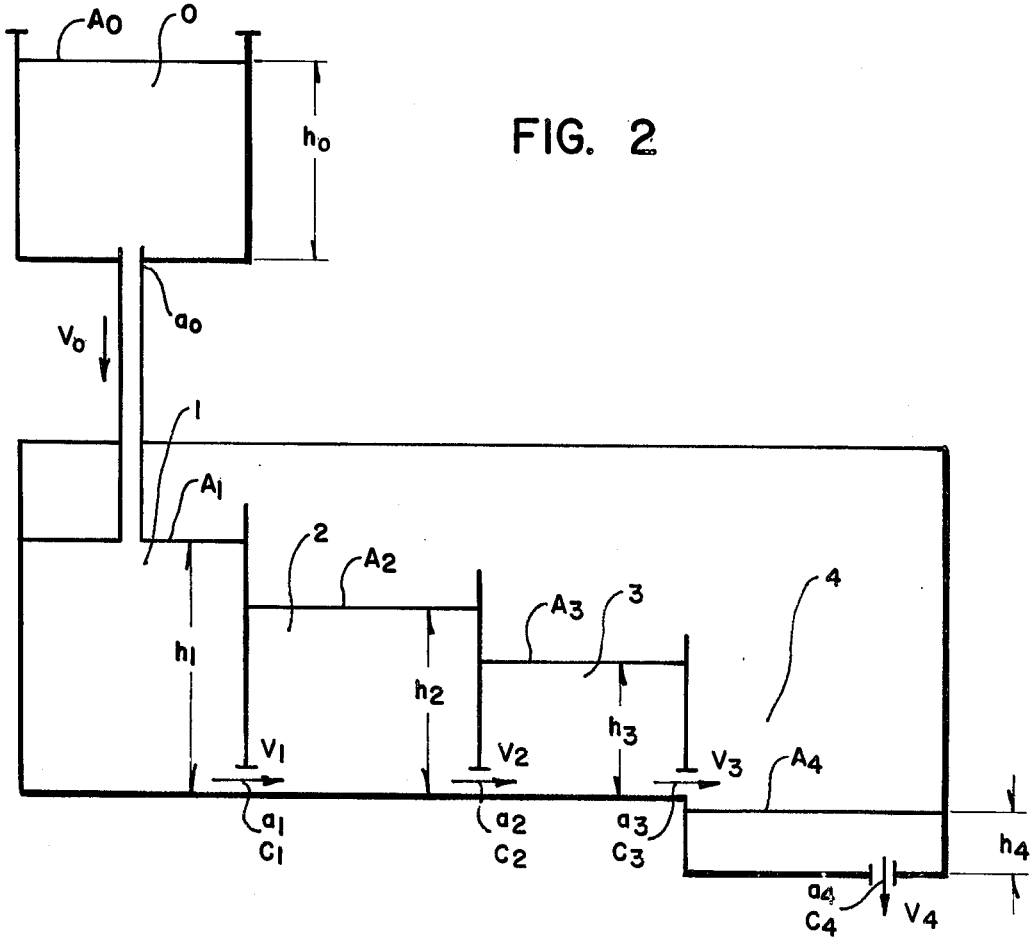
FIG. 2

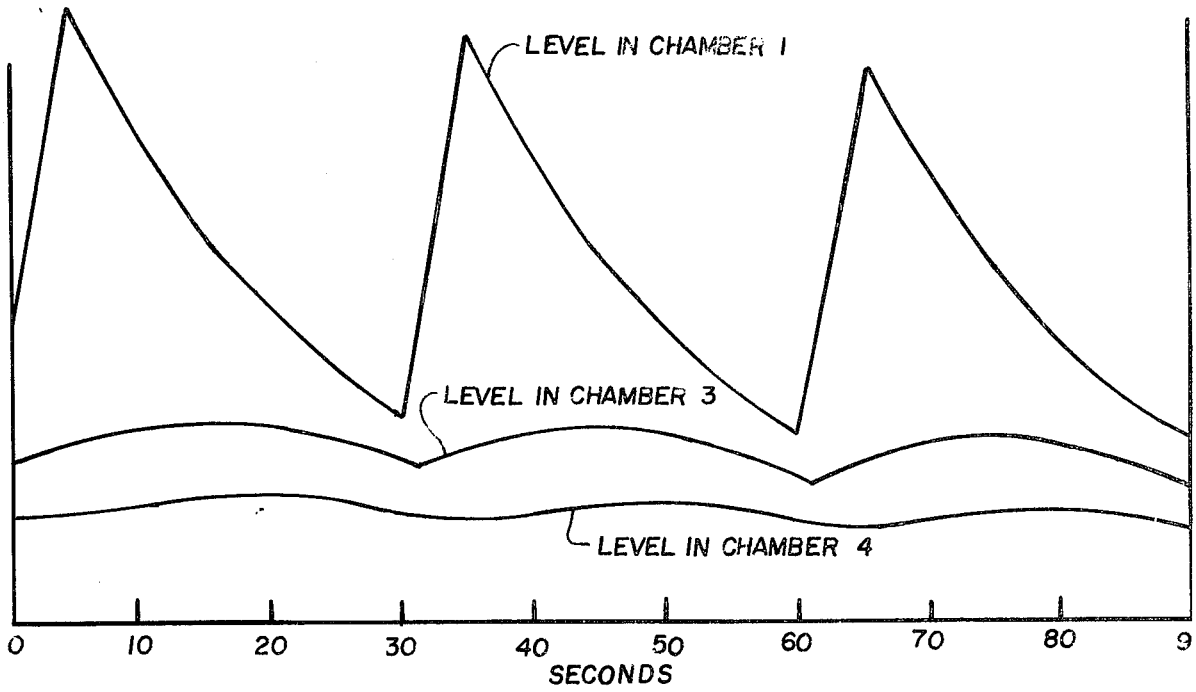
FIG. 3
FIG. 4
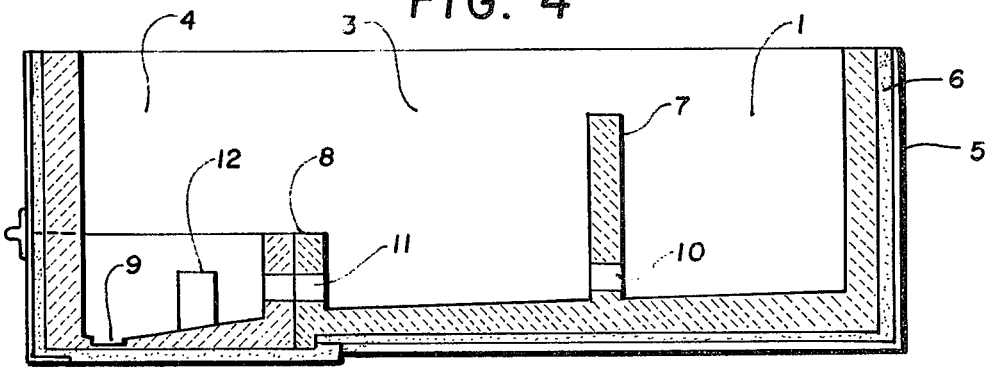
FIG. 5
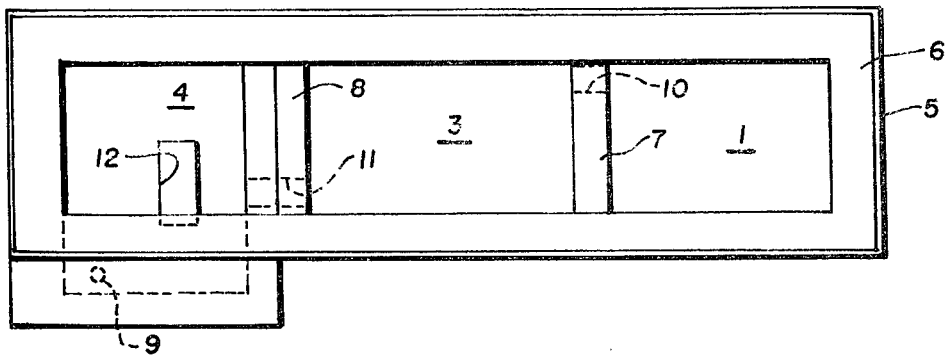

MULTI-CHAMBERED TUNDISH TO INDUCE DAMPENED FLOW

This is a division of application Ser. No. 470,510 filed May 16, 1974, now U.S. Pat. No. 3,907,163 which in turn is a division of application Ser. No. 324,700, filed Jan. 18, 1973, now U.S. Pat. No. 3,831,659.

Our invention is generally premised upon the discovery that a multichambered container may be utilized to transform a pulsating input stream of liquid material into a constant liquid stream having a low velocity. By a pulsating stream, it is meant a stream which has periods of nominally high flow rate interspersed with periods of low (and including zero) flow rate. It has been found that at least three chambers are necessary in order to be able to obtain the desired transformation. The technique briefly comprises feeding liquid material in a pulsating manner into an initial chamber of a multichambered container and subsequently, under the influence of gravity, flowing the liquid material into at least two succeeding chambers so as to dampen pulsations in liquid material level which are created in the initial chamber. The above procedure permits one to obtain a low and reasonably constant liquid material height in the final chamber of the container. Thus, by controlling the liquid level at a low height or hydrostatic head, a low and constant liquid velocity can be attained upon exit from the final chamber. A liquid stream having the above characteristics has obvious advantages for applications which require such feeding characteristics. The continuous casting of strip or strip casting is one such process. The term "strip casting" is intended to encompass any strip casting process where liquid material is poured onto a casting surface, permitted to solidify, and subsequently removed from the casting surface. Examples of such processes include strip castings produced upon contact with surfaces of rings, belts, drums, etc.

It is thus an object of our invention to provide a method and apparatus for transforming a pulsating flow of liquid into a continuous stream of low velocity.

It is a further objective to maintain a constant height or hydrostatic head over the position where the continuous stream exists from the flow transforming device.

It is an additional objective to form a liquid stream which is smooth, laminar, and non-splashing as such stream characteristics would minimize possible oxidization or contamination of the liquid stream.

It is yet an additional objective to provide a method and apparatus which will permit one to minimize the frequency of opening and closing of the feeding device which induces the initial pulsating flow. This objective would be beneficial in the case in which a refractory-lined ladle equipped with a stopper-rod were used as the intermittent feeding device because minimization of stopper-rod opening and closing would be beneficial to the prevention of ultimate leakage and refractory erosion at the stopper-nozzle interface.

It is also an objective of our invention to present a method and apparatus in which maximum sized orifices can be utilized. Such sized orifices have the advantage of being relatively free from blockage during operation and upon shut down of the unit. Thus, the ease of subsequent startups would be facilitated.

As it is advantageous to minimize the number of container chambers from the standpoint of ease of construction and maintenance, it is a still further object of our invention to minimize the number of chambers.

FIG. 1 is a photograph which illustrates evidence of remelting on the bottom surface of a cast strip which was cast from a high velocity tundish stream.

FIG. 2 depicts the symbols used in a mathematical model of the tundish system.

FIG. 3 represents the dynamic behavior of a three-chambered tundish system as predicted by a computer model for a particular set of conditions.

FIG. 4 is a front view of a tundish having three chambers.

FIG. 5 is a top view of a tundish having three chambers.

Figure 6:
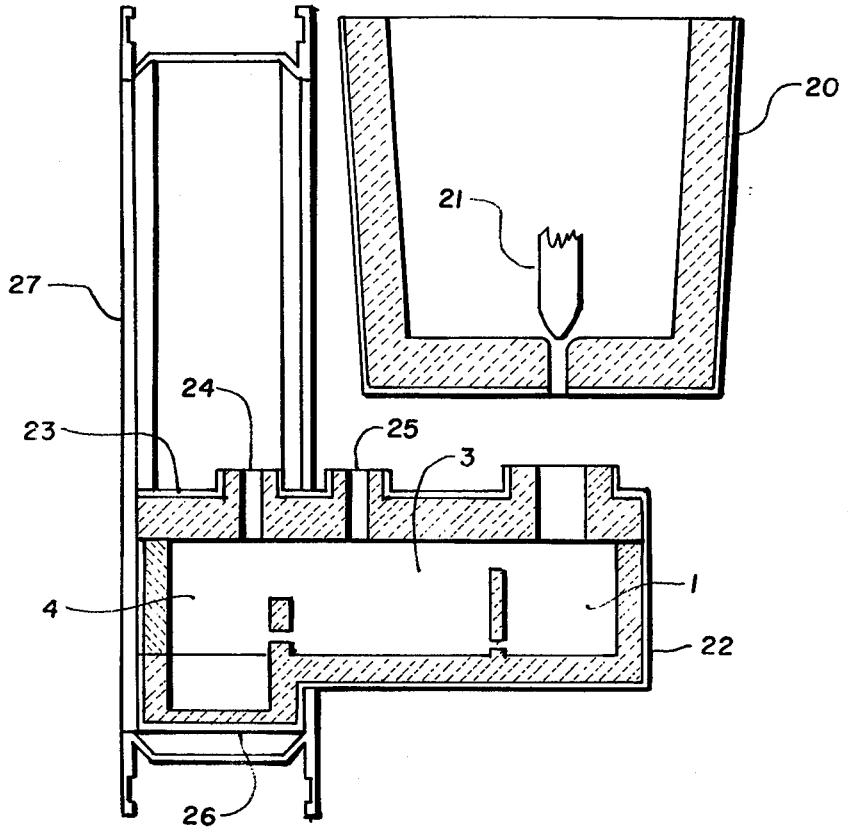
FIG. 6 depicts an overall view of metal feeding system in which a stoppered ladle, tundish, and ring casting system are included.

Our application is directed to a method and tundish apparatus which can transform a pulsating stream of liquid material of reasonable frequency into a relatively constant stream having a low velocity. In order to achieve the desired stream characteristics, a relatively constant, low liquid height or hydrostatic head must be created and maintained in the tundish chamber from which the liquid is exhausted. The velocity from the chamber is established by the nozzle or disc-orifice diameter used and the liquid head over the nozzle according to the following relationship:

$$V = c\sqrt{2gh}$$

where $V$ = velocity in feet per second $c$ = overall orifice (or nozzle) flow coefficient $g$ = 32.2 feet/second$^2$ $h$ = liquid height over orifice - feet For example, a one foot height of liquid over a nozzle with $c = 0.70$ will dispense liquid at a mean velocity of 5.62 feet per second.

Until the development of our invention, it had been difficult to effect the desired liquid level control in a tundish which was not segmented into at least three chambers. Such tundish designs led to undesirably high stream velocities when utilized as a source of feed material for continuous strip casting processes. For example, in the strip casting of steel there is much evidence discovered upon the ultimately cast strip which indicates that the stream permeates the casting pool and remelts a portion of the already formed strip at the bottom of the pool immediately under the stream. Such evidence is in the form of discrete solid patches which have the appearance of being cast into the bottom of the strip. In this regard see the photographic reproduction of a cast steel strip prepared by the well-known In-The-Ring strip casting technique which is depicted in FIG. 1. Once having permeated through the casting pool and the partially cast strip, the stream then locally impinges upon a portion of the casting ring which has already absorbed heat from the just cast strip. This additional heat source raises the casting ring surface temperature to an undesirably high value and thus contributes to resultant ring warpage. In extreme cases, such as those resulting from emergency stopping of the casting ring, the teeming stream can result in welding of the strip to the ring or even localized melting of the ring itself. Therefore, it may be clearly observed that a method and device which is capable of generating a constant stream of minimal velocity is of substantial worth in solving the above discussed problems when casting a metal strip that has a high melting point such as steel. In other words, the solution is believed to lie in reducing the hydrostatic head over the tundish teeming nozzle to the smallest possible value that is consistent with reasonable stream characteristics.

As a result of various studies, it has been determined that a tundish which has been partitioned into at least three chambers in series and which are interconnected by large, single orifices will provide a stream of the desired characteristics. Although pulse feeding results in relatively large surges in the initial chamber, the surges are rapidly dampened out in the subsequent chambers.

It should also be mentioned that, if the surface area of a single chambered tundish is sufficiently large, then in theory, a single chamber would be sufficient to obtain the requisite flow characteristics. However, such surface area would require a tundish of such a large size as to be impractical for the purposes of our invention. Our device not only smooths out regular pulsations with an apparatus of reasonable size, but can smooth out irregular pulsations as well. Such feature is of value where the ladle stopper-rod is being controlled manually.

In order to predict dynamic behavior of the above described system, a computer model for three-and four-chamber systems was formulated. The models were formulated by setting up differential equations of the hydraulic system. By considering the differential head across the several orifices and the net changes in head in each chamber due to input minus output, it can be shown that $$\frac{(a_o c_o \sqrt{2g})}{(A_o)} \sqrt{h_o} = \frac{dh_o}{dt} \quad (1)$$

$$\frac{(a_o c_o \sqrt{2g})}{(A_1)} \sqrt{h_o} - \frac{(a_1 c_1 \sqrt{2g})}{A_1} \sqrt{h_1 - h_2} = \frac{dh_1}{dt} \quad (2)$$

$$\frac{(a_1 c_1 \sqrt{2g})}{(A_2)} \sqrt{h_1 - h_2} - \frac{(a_2 c_2 \sqrt{2g})}{(A_2)} \sqrt{h_2 - h_3} = \frac{dh_2}{dt} \quad (3)$$

$$\frac{(a_2 c_2 \sqrt{2g})}{(A_3)} \sqrt{h_2 - h_3} - \frac{(a_3 c_3 \sqrt{2g})}{(A_3)} \sqrt{h_3} = \frac{dh_3}{dt} \quad (4)$$

$$\frac{(a_4 c_4 \sqrt{2g})}{(A_4)} \sqrt{h_4} = \frac{dh_4}{dt} \quad (5)$$

where the above symbols are as defined in FIG. 2.

As may be observed from FIG. 2, the above equations are for a four-chamber tundish design, each chamber being numbered in the drawing. Although non-linear these equations are easily programmed for computer solution using various initial conditions. Also, the condition of intermittant feeding from source vessel 0 to chamber 1 of FIG. 2 may be applied by assuming a time cycle of constant period during some fixed portion of which $V_o$ is set equal to zero.

If the partition between chambers 2 and 3 of FIG. 2 is eliminated, the equations become $$\frac{(a_o c_o \sqrt{2g})}{(A_o)} \sqrt{h_o} = \frac{dh_o}{dt} \quad (1)$$

$$\frac{(a_o c_o \sqrt{2g})}{(A_1)} \sqrt{h_o} - \frac{(a_1 c_1 \sqrt{2g})}{(A_1)} \sqrt{h_1 - h_3} = \frac{dh_1}{dt} \quad (2a)$$

$$\frac{(a_1 c_1 \sqrt{2g})}{(A_3)} \sqrt{h_1 - h_3} \frac{(a_3 c_3 \sqrt{2g})}{(A_3)} \sqrt{h_3} = \frac{dh_3}{dt} \quad (4a)$$

$$\frac{(a_4 c_4 \sqrt{2g})}{(A_4)} \sqrt{h_4} = \frac{dh_4}{dt} \quad (5)$$

FIG. 3 is a graphical depiction of the results of the three-chambered computer model predictions for a few cycles of operation. The conditions used for the model were as follows:

a. Initial head in ladle = 30 in.
b. Ladle liquid surface area taken as 707 in.$^2$ constant
c. Ladle nozzle diameter = 1¼ in., flow coefficient = 1.0
d. Initial head in all tundish chambers = 0
e. Surface area of chambers 1 and 3 taken as 99 and 144 in.$^2$ respectively. Area of chamber 4 is variable depending upon liquid height (27½ in.$^2$ minimum)
f. Disc nozzles or orifices connecting chambers 1 and 3 and chambers 3 and 4 are 1 in. dia. with flow coefficients taken as 0.7 constant.
g. Nozzle draining chamber 4 is 1⅛ in. dia.
h. Ladle cycle time = 30 sec.
i. Ratio of ladle time /total cycle = 1/6

As may be observed from FIG. 3, a three-chambered tundish design provides significant dampening in intermediate chamber 3 and a near absence of head variation in final chamber 4.

Based upon conclusions drawn from the above computer similations, a plexiglass model consisting of four chambers connected by single orifices was constructed and tested with water being used as the liquid material. Gross fluxuations of water level in the initial chamber (input) were completely dampened out to zero in the fourth or final chamber (discharge). These results indicated the reliability of the computer model predictions. A three-chamber model design was also tested. Although the total dampening effect was reduced somewhat, the results were satisfactory. Moreover, the three-chamber design offers advantages with regard to simplification of the internal design and to the facilitation of servicing of the apparatus. Satisfactory trials were also conducted using liquid steel and a refractory-lined tundish.

Thus, it may be seen that a tundish design which incorporates at least three chambers is necessary for the requisite dampening effect which results in the creation of a relatively constant liquid stream having a low or minimal velocity. Based upon considerations presented above, it may be further seen that a tundish having three chambers represents a preferred embodiment of our invention. FIG. 4 is a front view of the preferred tundish. The tundish is capable of transforming a pulsating stream of a liquid material, for example, steel, into a relatively constant stream having a low velocity. The tundish is comprised of a container 5 which is lined with a refractory material 6 when high temperature liquids, such as steel, are handled. The container has a generally sloping bottom and sidewalls. Container 5 is separated into three chambers 1, 2, and 3 by means of partitions 7 and 8. Chamber 1 comprises the initial chamber and is adapted for receiving and holding the liquid material. Chamber 3 comprises an intermediate holding chamber and chamber 4 comprises the final chamber which is adapted to hold and dispense the liquid material. Dispensing means 9, preferably in the form of a nozzle, are connected to the bottom of final chamber 4 to provide for exhaustion of liquid material. As would occur to those skilled in the art, the dispensing means could comprise multiple nozzles. Orifice means 10 and 11 are incorporated into and pass through partition means 7 and 8 respectively in order to interconnect chambers 1 and 3 and 3 and 4 respectively. This will allow liquid to flow between the respective chambers. The orifices are preferably located near the bottom of the partition means in order to minimize exposure of the liquid to potential oxidation or contamination by the atmospheric environment in the tundish. Such location is also beneficial when metal liquids are being treated as any protective blanket of slag on top of the liquid metal in the respective chambers would be relatively undisturbed by consequent metal flow patterns. Orifice means 10 and 11 are also preferably of a large or maximum size in order to avoid clogging or blockage due to various solid impurities during operation and upon shutdown of the device. The orifices are also preferably located so that they are not in a direct liquid flow line with respect to each other. In other words, a degree of directional offset is preferred. Such offset would serve to minimize the amount of liquid carryover velocity from a preceding chamber and thus be helpful in obtaining the desired dampening effect. Flow diverting means 12 are preferably utilized in final chamber 4. Suitable means would include a baffle connected to the floor of final chamber. The diverting means function to reduce the creation of an undesirable vortex condition at dispensing means 9. A vortex condition could lead to undesirable erosion of the dispensing means nozzle, poor pouring characteristics such as splashing, and excessive reoxidation or recontamination of the liquid.

FIG. 5 represents a top view of the preferred three chamber tundish. This view illustrates the previously mentioned aspect of using offset connecting orifices.

FIG. 6 is illustrative of the use of a three-chambered tundish 22 comprising chambers 1, 3, and 4 in combination with a refractory-lined ladle 20 which has a stopper-rod 21 to provide a pulsating, intermittent source of liquid material to initial chamber 1 of the tundish. Tundish 22 may be provided with a cover 23 and burner ports 24 and 25 for auxiliary heating in the event that it is desired to heat the liquid material. The pulsating liquid material enters initial tundish chamber 1 and passes through chambers 3 and 4 prior to exiting at nozzle 26, being received in a pool, and subsequently cast by ring casting device 27.

As set forth previously, our invention also comprises a method of obtaining a low velocity liquid stream. The method comprises the steps of feeding a liquid material in a pulsating manner into an initial chamber of a multi-chamber vessel or container and subsequently flowing, under the influence of gravity, the liquid through at least an intermediate and final chamber so as to dampen pulsations which were created in the initial chamber, and finally dispensing the liquid, under the influence of gravity, from the final chamber. This method has particular utility in providing a casting stream of characteristics that are desirable for use in conjunction with the strip casting of ferrous or nonferrous metals such as steel, copper, aluminum, etc. The casting stream is characterized as smooth, laminar and non-splashing. It is a preferred embodiment of our method to divert the liquid flow prior to exit from the final chamber in a manner which will reduce any tendency to form an undesirable vortex flow condition as the liquid is dispensed from the final chamber.

We claim:

1. A tundish for dispensing liquid material at a low velocity, comprising:

a. a container capable of holding liquid material having sidewalls attached to a generally sloped bottom;

b. partition means connected to said container bottom and sidewalls for separating said container into at least three chambers, which chambers comprise an initial chamber adapted for receiving and holding the liquid material, an intermediate chamber for holding the liquid material, and a final chamber for holding and dispensing the liquid material;

c. dispensing means connected to the final chamber for dispensing the liquid material; and d. orifice means connected to said partition means for providing an interconnection between said chambers so as to permit the liquid metal to flow under the influence of gravity from the initial chamber to an intermediate chamber and from an intermediate chamber to the final chamber.

2. A tundish for dispensing liquid material at a low velocity as recited in claim 1, wherein:

said container has three chambers.

3. A tundish for dispensing liquid material at a low velocity as recited in claim 1, further comprising:

flow diverting means connected to the final chamber for reducing the degree of swirl of the liquid material entering said dispensing means.

4. A tundish for dispensing liquid material at a low velocity as recited in claim 1, wherein:

said orifice means are located near to the bottom of said container.

* * * * *